US006362571B1

(12) United States Patent
Suijker et al.

(10) Patent No.: US 6,362,571 B1
(45) Date of Patent: Mar. 26, 2002

(54) METAL-HALIDE LAMP WITH IONIZABLE FILLING AND OXYGEN DISPENSER TO AVOID BLACKENING AND EXTEND LAMP LIFE

(75) Inventors: Joseph L. G. Suijker, Eindhoven (NL); Marinus C. Raas, Turnhout (BE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/286,116

(22) Filed: Apr. 2, 1999

(30) Foreign Application Priority Data

Apr. 8, 1998 (EP) ..... 98201119

(51) Int. Cl.[7] ..... H01J 17/20; H01J 61/12

(52) U.S. Cl. ..... 313/637; 313/638; 313/639; 313/567

(58) Field of Search ..... 313/637, 638, 313/639, 640, 641, 642, 643, 567, 579

(56) References Cited

U.S. PATENT DOCUMENTS 3,234,421 A * 2/1966 Reiling ..... 313/25
3,279,877 A * 10/1966 Smith et al. ..... 313/571
3,781,586 A * 12/1973 Johnson ..... 313/642
3,882,343 A * 5/1975 Speros et al. ..... 313/639
3,882,345 A * 5/1975 Kazek et al. ..... 313/639
4,027,190 A * 5/1977 Shintani et al. ..... 313/639
4,052,634 A * 10/1977 De Kok ..... 313/642
4,360,758 A * 11/1982 Thornton et al. ..... 313/642
4,620,128 A * 10/1986 Luthra ..... 313/630
4,672,267 A * 6/1987 Lapatovic et al. ..... 313/571
4,742,268 A * 5/1988 Caruso et al. ..... 313/638
5,424,609 A 6/1995 Geven et al. ..... 313/623
5,986,405 A * 11/1999 De Maagt et al. ..... 313/637
6,060,829 A * 5/2000 Kubon et al. ..... 313/633
6,169,365 B1 * 1/2001 Kubon et al. ..... 313/631

FOREIGN PATENT DOCUMENTS

EP 215524 9/1986 ..... H02J/61/30

* cited by examiner

*Primary Examiner*—Nimeshkumar D. Patel
*Assistant Examiner*—Mariceli Santiago
(74) *Attorney, Agent, or Firm*—Dicran Halaian

(57) ABSTRACT

A metal-halide lamp including a discharge vessel with a ceramic wall, the discharge vessel enclosing a discharge space which contains an ionizable filling which filling contains halides of Na and Tl in addition to Hg. The ionizable filling also contains Ca and is free from rare-earth halides.

9 Claims, 1 Drawing Sheet

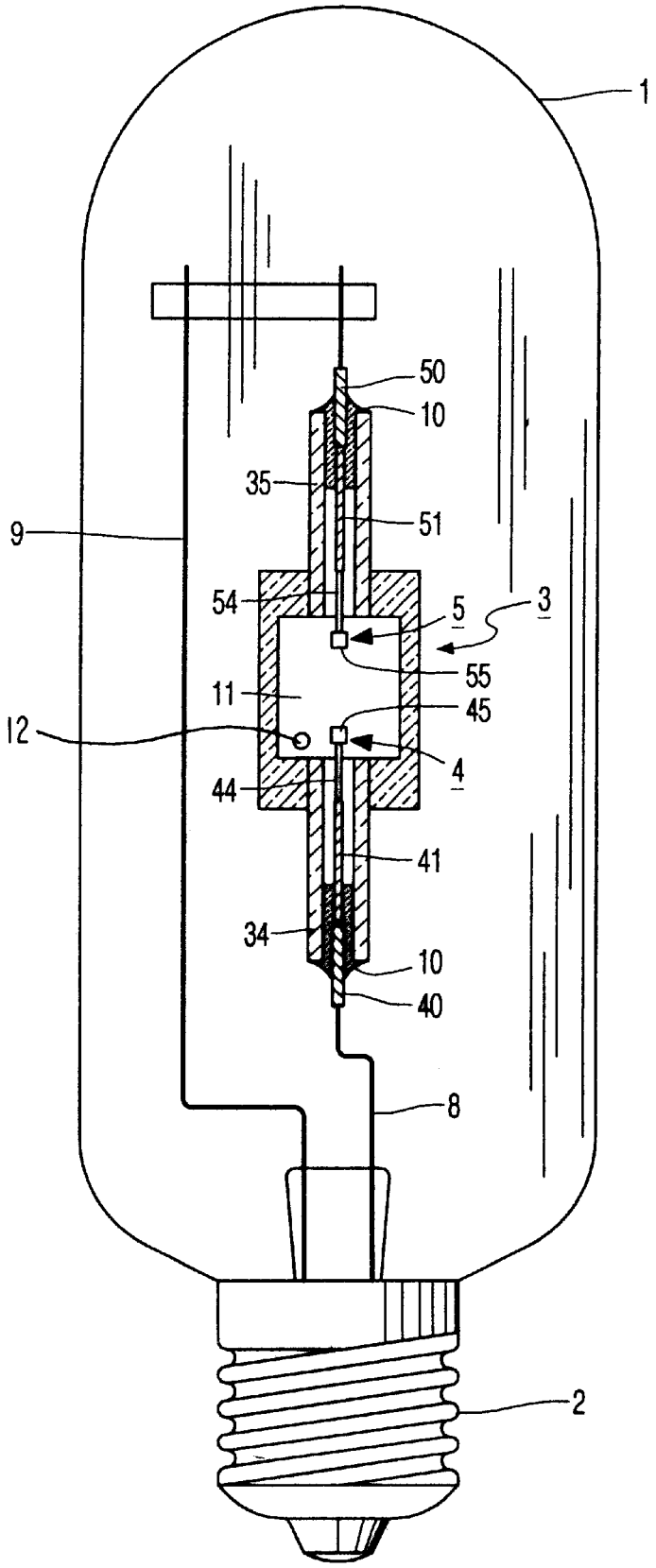
1
50
10
35
51
9
54
5
3
55
11
45
12
4
44
41
34
10
40
8
2

METAL-HALIDE LAMP WITH IONIZABLE FILLING AND OXYGEN DISPENSER TO AVOID BLACKENING AND EXTEND LAMP LIFE

BACKGROUND OF THE INVENTION

The invention relates to a metal-halide lamp comprising a discharge vessel with a ceramic wall, the discharge vessel enclosing a discharge space which contains an ionizable filling which filling contains halides of Na and Tl in addition to Hg.

A lamp of the type defined in the opening paragraph is known from EPA-A-0 215 524. The lamp comprises tungsten electrodes. The known lamp, which combines a high specific luminous flux with excellent color properties (inter alia general color rendition index $R_a \geqq 80$ and a color temperature $T_c$ between 2600 and 4000 K), is highly suitable as a light source for, for example, interior lighting. With this lamp the perception is used to advantage that a good color rendition is possible when Na-halide is used as a filling component of a lamp and, when the lamp is in operation, there is a strong widening and reversal of the Na emission in the Na-D lines. This requires a high cold spot temperature $T_{kp}$ in the discharge vessel of at least 1170 K (900° C.). When the Na-D lines are reversed and widened, they assume in the spectrum the form of an emission band having two maximums mutually $\Delta\lambda$ apart.

The requirement of a large value of $T_{kp}$ entails that the discharge vessel is relatively small, excludes the use of quartz or quartz glass for the wall of the discharge vessel and forces one to use ceramic for the wall of the discharge vessel.

In this description and these claims the ceramic wall is understood to mean both a wall of metal oxide such as, for example, sapphire or sintered polycrystalline $Al_2O_3$, and metal nitride, for example, AlN.

The filling of the discharge vessel contains besides Na and Tl, one or more rare-earth metals with which a desired value for the general color rendition index $R_a \geqq 80$ and the color temperature $T_c$ is realized. Rare-earth metals in this description and these claims are understood to mean the elements Sc, Y and the lanthanides.

A disadvantage of the known lamp is that under the influence of the rare-earth metals present during lamp operation there is corrosion of parts of the discharge vessel, more particularly, the wall. This finally results in a premature end of the lamp life. A further disadvantage of the known lamp is that also due to the relatively small dimensions of the discharge vessel, a relatively fast blackening of the wall of the discharge vessel occurs owing to deposition on the wall of W evaporated from the electrodes.

SUMMARY OF THE INVENTION

In a lamp according to the invention the ionizable filling also contains Ca and is free from rare-earth halides.

As a result of a surprisingly large spectral contribution of Ca both to the red and the blue, a value of $R_a \geqq 80$ is realized for the general color rendition index and $T_c$ up to 3500 K is realized for the color temperature. In addition, it surprisingly appears that formation of stable Ca aluminate compounds is eliminated and the Ca present causes a W-halide cycle to develop as a result of which also the blackening of the wall of the discharge vessel owing to the evaporation of W of the electrodes is strongly counteracted. A condition for the occurrence of the W-halide cycle is the presence in the discharge vessel of a small quantity of free oxygen. Generally, the quantity of free oxygen comes from contaminations occurring during the manufacture of the lamp and released therefrom when the lamp is in the operating state. It has also been established that oxygen is released from the ceramic wall material under the influence of reactions with filling components of the discharge vessel. In the case of too small a concentration, it will hardly be possible to maintain the W-halide cycle sufficiently during the operation of the lamp. In the case of too large a concentration there will be, inter alia, corrosion of the W-electrodes.

In a preferred embodiment, the discharge vessel contains an oxygen dispenser. This has the important advantage that oxygen is introduced into the discharge vessel in a controlled manner. Bearing in mind an accuracy of manufacture required for a proper operation of the lamp and consequent scaling down of contaminations, there is a large chance of too small a concentration with respect to the quantity of $O_2$ that is released from contaminations. An additional advantage of the lamp according to the preferred embodiment is that dosaging during the life of the lamp becomes possible. In an advantageous embodiment of the lamp according to the invention, the oxygen dispenser contains CaO. CaO is advantageous in that by itself it forms part of the filling of the discharge vessel.

The filling of the discharge vessel can, in addition to Na and Tl, contain one or more metals, inter alia, for affecting the color properties of the lamp, for example, In. Besides the exclusion of rare-earth metals, a use of Ti, Zr and Hf is less suitable for the filling, because they form relatively stable oxides.

Experiments have shown that a value for $\Delta\lambda$ between 12 nm and 60 nm is desired for effecting good color properties of the lamp. With a value for $T_{kp}$ in a range between 1200 K and 1300 K, a desired magnitude for $\Delta\lambda$ may generally be practicable, while also a maximum temperature of the wall of the discharge vessel up to 1450 K can be realized.

BRIEF DESCRIPTION OF THE DRAWINGS

The drawing shows a metal-halide lamp with a cut-away view of a discharge vessel, not shown to scale, having a ceramic wall which encloses a discharge space 11. The discharge space contains an ionizable filling which in the case shown contains not only Hg, but also Na and Tl halide. The filling also contains an oxygen dispenser 12 containing CaO, for example in the form of a ceramic CaO-impregnated carrier. Two electrodes 4, 5 having electrode rods 44, 54 and tops 45, 55 in a drawing each comprised of W, are arranged in the discharge vessel. The discharge vessel is closed on one side by a ceramic protruding plug 34, 35, which closely surrounds with clearance a lead-in 40, 41; 50, 51 respectively, to the electrode 4, 5 arranged in the discharge vessel, and is connected thereto in a gastight manner by means of a melting-ceramic joint 10 adjacent an end turned away from the discharge vessel. The construction of the discharge vessel is known per se, for example, from U.S. Pat. No. 5,424,609. The discharge vessel is surrounded by an outer bulb 1 on one end, having a lamp base 2. Between electrodes 4, 5 there is a discharge when the lamp is in operation. Electrode 4 is connected via a conductor 8 to a first electrical contact which forms part of the lamp base 2. Electrode 5 is connected via a conductor 9 to a second electrical contact which forms part of the lamp base 2.

DETAILED DESCRIPTION OF THE PREFERRED EMBODIMENTS

In a practical embodiment of a lamp according to the invention as described in the drawing, the nominal power of the lamp is 70 W and the lamp has a nominal lamp voltage of 90V. The translucent wall of the discharge vessel has a thickness of 0.8 mm. The inner diameter of the discharge vessel is 6.85 mm, the distance between the electrode tops is 7 mm. The ionizable filling of the lamp contains in addition to 4.6 mg Hg, 7 mg (Na+Tl+Ca), iodide having a weight percentage composition of 28.8; 10.7 and 60.5. The discharge vessel also contains Ar as a start enhancer with a filling pressure of 300 mbar. During the operation of the lamp, $T_{kp}$ is 1265 K. The lamp emits light with a specific luminous flux of 90 lm/W for 100 hours. The color temperature $T_c$ of the emitted light is 3150 K. The general color rendition $R_a$ is 84. After 10,000 burning hours the specific light stream is 88% of the value of 100 hours.

What is claimed is:

1. A metal-halide lamp comprising a discharge vessel (3) with a ceramic wall, the discharge vessel enclosing a discharge space (11) which contains an ionizable filling which filling contains halides of Na and Tl in addition to Hg, and also contains Ca and is free from rare-earth halides.

2. A lamp as claimed in claim 1, wherein the discharge vessel contains a solid phase oxygen dispenser.

3. A lamp as claimed in claim 2, wherein the oxygen dispenser contains CaO.

4. A metal-halide lamp comprising a discharge vessel with a ceramic wall, the discharge vessel enclosing a discharge space which contains an ionizable filling, said ionizable filling containing non-rare earth metal halides and a solid phase oxygen dispenser to introduce oxygen into the discharge vessel in a controlled manner.

5. The metal-halide lamp of claim 4, wherein said oxygen dispenser provides oxygen dosaging during life of the metal-halide lamp.

6. The metal-halide lamp of claim 4, wherein said oxygen dispenser contains CaO.

7. The metal-halide lamp of claim 4, wherein said ionizable filling contains Ca.

8. The metal-halide lamp of claim 4, wherein said oxygen dispenser is a ceramic CaO impregnated carrier.

9. The metal-halide lamp of claim 4, wherein said oxygen dispenser contains CaO, said CaO providing said ionizable filling with Ca configured to maintain a general color rendition index ≧80 and color temperature to 3500° K. during life of the metal halide lamp.

* * * * *